US005652609A

United States Patent [19]

Scholler et al.

[11] Patent Number: 5,652,609

[45] Date of Patent: Jul. 29, 1997

[54] RECORDING DEVICE USING AN ELECTRET TRANSDUCER

[75] Inventors: J. David Scholler, 3844 Elm Ave., Long Beach, Calif. 90807; Ayekavadi Gururaj, Torrance, Calif.

[73] Assignee: J. David Scholler, Rolling Hills Estates, Calif.

[21] Appl. No.: 74,174

[22] Filed: Jun. 9, 1993

[51] Int. Cl.[6] ..... B41J 2/04

[52] U.S. Cl. ..... 347/54

[58] Field of Search ..... 347/54, 68, 71, 347/70, 47, 20; 310/800, 308; 307/400; 29/25.35, 631.1

[56] References Cited

U.S. PATENT DOCUMENTS

| | | | |
|---|---|---|---|
| 2,512,743 | 6/1950 | Hansell | 347/68 X |
| 3,747,120 | 7/1973 | Stemme | 347/70 |
| 3,857,049 | 12/1974 | Zoltan | 347/68 X |
| 3,924,324 | 12/1975 | Kodera | 307/400 X |
| 3,946,398 | 3/1976 | Kyser et al. | 347/70 |
| 4,127,681 | 11/1978 | Ferren et al. | 29/631.1 |
| 4,296,421 | 10/1981 | Hara et al. | 347/68 X |
| 4,312,008 | 1/1982 | Taub et al. | 347/71 |
| 4,346,505 | 8/1982 | Lemonon et al. | 29/25.35 |
| 4,379,246 | 4/1983 | Guntersdorfer et al. | 310/800 X |
| 4,383,264 | 5/1983 | Lewis | 347/68 |
| 4,434,430 | 2/1984 | Koto | 347/70 |
| 4,536,097 | 8/1985 | Nilsson | 347/71 |
| 4,550,326 | 10/1985 | Allen et al. | 347/47 |
| 4,588,998 | 5/1986 | Yamamuro et al. | 310/800 X |
| 4,680,859 | 7/1987 | Johnson | 347/56 |
| 4,742,365 | 5/1988 | Bartky et al. | 347/71 |
| 4,845,512 | 7/1989 | Arway | 347/77 |
| 4,901,093 | 2/1990 | Ruggerio et al. | 347/47 X |
| 5,235,352 | 8/1993 | Pies et al. | 347/71 |
| 5,262,804 | 11/1993 | Petigrew et al. | 347/88 X |

FOREIGN PATENT DOCUMENTS 58-12767 1/1983 Japan .

OTHER PUBLICATIONS

Gerhard–Multhaupt, R. "Electrets: Dielectrics With Quasi–Permanent Charge or Polarization". *IEEE Transactions on Electrical Insulation.* vol. EI–22 No. 5, Oct. 1987.

*Primary Examiner*—Benjamin R. Fuller
*Assistant Examiner*—Alrick Bobb
*Attorney, Agent, or Firm*—Townsend and Townsend and Crew LLP

[57] ABSTRACT

A recording device is disclosed which in a preferred embodiment comprises a recording head comprising at least one chamber having an orifice therein, at least a portion of the chamber comprising an electret transducer; a recording medium for supplying recording medium from a reservoir to the chamber, and for a voltage pulse source and electrode applying a voltage pulse to the electret to deform the electret to change the volume of the chamber and eject a quantity of recording medium from the chamber through the orifice. The invention and device is further useful in manufacturing high density printheads, operable with multiple recording mediums to print recording medium on a recording surface.

32 Claims, 5 Drawing Sheets

RECORDING DEVICE USING AN ELECTRET TRANSDUCER

BACKGROUND OF THE INVENTION

The present invention relates to the field of recording devices generally known as ink jet printers. More particularly, in one embodiment, the invention provides a recording head comprising an electret transducer effective to eject a quantity of ink to a recording medium.

Variations of direct marking electronic ink jet-type printers and their components have been well known for some number of years. Ink-jet printers may be classified in two general categories; continuous ink flow and drop-on-demand printers. In the continuous ink jet system, fine droplets of ink are continuously ejected from the printhead. Among the continuous fine droplets so ejected, those droplets required to effect the recording are selectively deflected and deposited to a recording surface.

The continuous ink jet systems generate a continuous stream of ink "drops" on the order of about a million drops per second. The drops are electrically charged and selectively deflected onto the recording medium or to a gutter-waste ink collection system. The continuous ink jet-type printer has met with substantial success, and there are several commercial systems operating on the continuous ink jet principle. However, there are many drawbacks to the continuous ink jet system. One shortcoming relates to the limited speed of the print system since relatively few such ink jet streams are typically used.

Drop-on-demand type ink jet printers are advantageous in some respects compared to the continuous type due primarily to a reduction in complexity. Drop-on-demand type systems do not require components such as ink charge inducers and a deflection controlling mechanism for separating the continuous ink droplets and collecting and recycling those not selected for printing. The drop-on-demand type system is therefore somewhat simpler in structure and may be minimized in size. The drop-on-demand type ink jet printers are designed to controllably eject an ink drop only as required. In a drop-on-demand printhead, multiple ink nozzles may be arranged in an array and thereby improve the speed and performance of the drop-on-demand type printers relative to continuous type ink jet printers. An early drop-on-demand device is described in U.S. Pat. No. 2,512,743 issued Jun. 27, 1950 to C. W. Hansell. Later devices include those disclosed in U.S. Pat. No. 3,747,120 issued Jul. 17, 1973 to Stemme. Further discussion of the drop-on-demand type system may be found in *IEEE Transactions on Industry Applications*, Vol. IA-13, No. 1, January/February 1977.

The above described early drop-on-demand type ink jet type devices remain complex, utilizing energy producing elements of bimorph or monomorph ceramic piezoelectric material such as PZT (lead zirconium titanate). The piezo type printers remained mechanically complex and difficult to manufacture. The relatively large size of the piezo transducer prevents a close spacing of the ink ejecting nozzles and physical limitations inherent with the piezo transducer result in a low ink drop velocity. Also, the piezo vibrating element is technically difficult to manufacture and assemble. The piezo based devices are generally limited to between 10 and 60 nozzles. Further, the piezo-type devices require a voltage in the range of from about 100 to 200 volts depending on the piezo material employed. Overall, such limitations combine to result in a relatively low print speed, even when a moving shuttle type print head is employed.

Somewhat more recently, thermal based ink jet print systems have been described, for example, in U.S. Pat. No. 4,296,421 issued Oct. 20, 1981 to Hara et al., and U.S. Pat. No. 4,680,859 issued Jul. 21, 1987 to Samuel A. Johnson. The nozzles in a thermal ink jet system may be arranged in a very close pattern, with about 50 to 70 nozzles per printhead possible using semiconductor based manufacturing technologies. Indeed, even full page wide printers comprising from about 2400 to 4800 nozzles in line at a density of about 400 spots per inch have been manufactured, and some have print speeds of up to 100 pages per minute.

Even having met with considerable commercial success, thermal ink jet systems still have many shortcomings and limitations. For example, since thermal energy is used for ink drop generation, the ink solution must be superheated to several hundred degrees Fahrenheit, in order to generate the vapor bubble causing ejection of a drop of aqueous based ink. Ink additives which may greatly improve the print quality are excluded from the thermal ink jet systems as they are detrimental to the reliability of the heating elements.

Further associated with thermal based systems, repeated heating and associated collapsing pressure serves to limit the useful life of thermal print heads. Another problem relates to the very low overall thermal drop generation mechanism efficiency, which is on the order of about 0.005%. The thermal systems generate considerable excess heat which causes severe thermal effect problems, particularly in the larger printers. Still yet another problem encountered in the thermal ink jet printing system is that of water absorption. Due to the qualities of aqueous ink, absorption onto the recording medium often results in a cockle or paper wrinkling. This unfortunate result prevents good registration of ink onto the paper and detrimentally affects print and color quality.

From the above it is seen that an improved ink jet print head device and associated method of fabrication is desired not only to provide print head and associated printers with improved performance but also to provide devices which may be simpler to manufacture and use and which are therefore more reliable.

SUMMARY OF THE INVENTION

The present invention provides for the use of an electret transducer as the force generating element in a fluid ejecting device as an ink jet printer. In the preferred embodiments, the electret transducer comprises one electrode in association with a metallized conductor as a cooperating electrode, the electrodes separated by an air gap. Electrets are dielectric materials capable of permanent charge storage, and are electrical analog of magnets. Electrets can have fixed positive and/or negatively stored charges and polarized dipoles. The present invention recognizes and takes advantage of the above properties.

In one embodiment the invention provides a high resolution multiple nozzle ink jet printing system comprising a plurality of fluid containing chambers comprising deformable electret transducers for ejecting liquid droplets on demand through orifices located within the fluid containing chambers.

The invention also provides devices and methods enabling the construction of high density printer arrays comprising a plurality of electret transducers. Such devices are operable with a greater number of recording fluids with minimal degradation of device reliability.

In one embodiment, the invention provides a recording device comprising a recording head including at least one chamber having an orifice therein, at least a portion of one wall of the channel comprising a polymer film electret; means for supplying recording medium to the chamber; and means for applying a voltage pulse to the electret to deform the electret to decrease the volume of the chamber and eject a quantity of recording medium from the chamber through the orifice.

In another embodiment, the present invention provides a process for manufacturing a drop-on-demand recording print head including the steps of defining at least one channel in a substrate and placing an electret material adjacent the substrate to form at least a portion of the confining structure of a chamber; and providing means to induce a voltage pulse to the electret.

A layer of polymer film electret, when disposed and carefully aligned between photolithographically defined chambers and electrode surfaces, can be selectively deformed, causing the ejection of a predetermined quantity of recording medium from the chamber orifice. The frequency response of the electret to the voltage pulse is excellent, and control of the fluid ejection in response to the applied electrical impulse is very high. The utilization of a polymer film electret capacitor in the device and methods of the present invention results in a greatly reduced amount of energy required to eject a fluid drop in response to an electric signal.

The electret polymer may be a single polymer electret film, blend of polymers or a multiple layer polymer electret film (bi-polymeric electret), or multiple conducting films with multiple polymers in other embodiments. The electret transducer may be employed as a single dielectric layer capacitor or as a multi-dielectric capacitor in one embodiment.

In one embodiment, the present invention comprises an electret transducer in which at least one electrode is an electret and at least one electrode is a flexible membrane. The charges and permanent dipoles comprising the electret greatly increase the force between the electrodes. Such force can be as much as two orders of magnitude greater than conventional metal film capacitors. This increase in force between the electrodes due to the presence of the electret results in a minimum amount of energy required to eject a fluid drop in response to an electric signal driving the capacitor.

In another embodiment of the invention, a printer having improved performance comprises a printhead in accordance with the above described embodiments.

A further understanding of the nature and advantages of the inventions herein may be realized by reference to the remaining portions of the specification and the attached drawings.

DESCRIPTION OF SPECIFIC EMBODIMENTS

Figure 1:
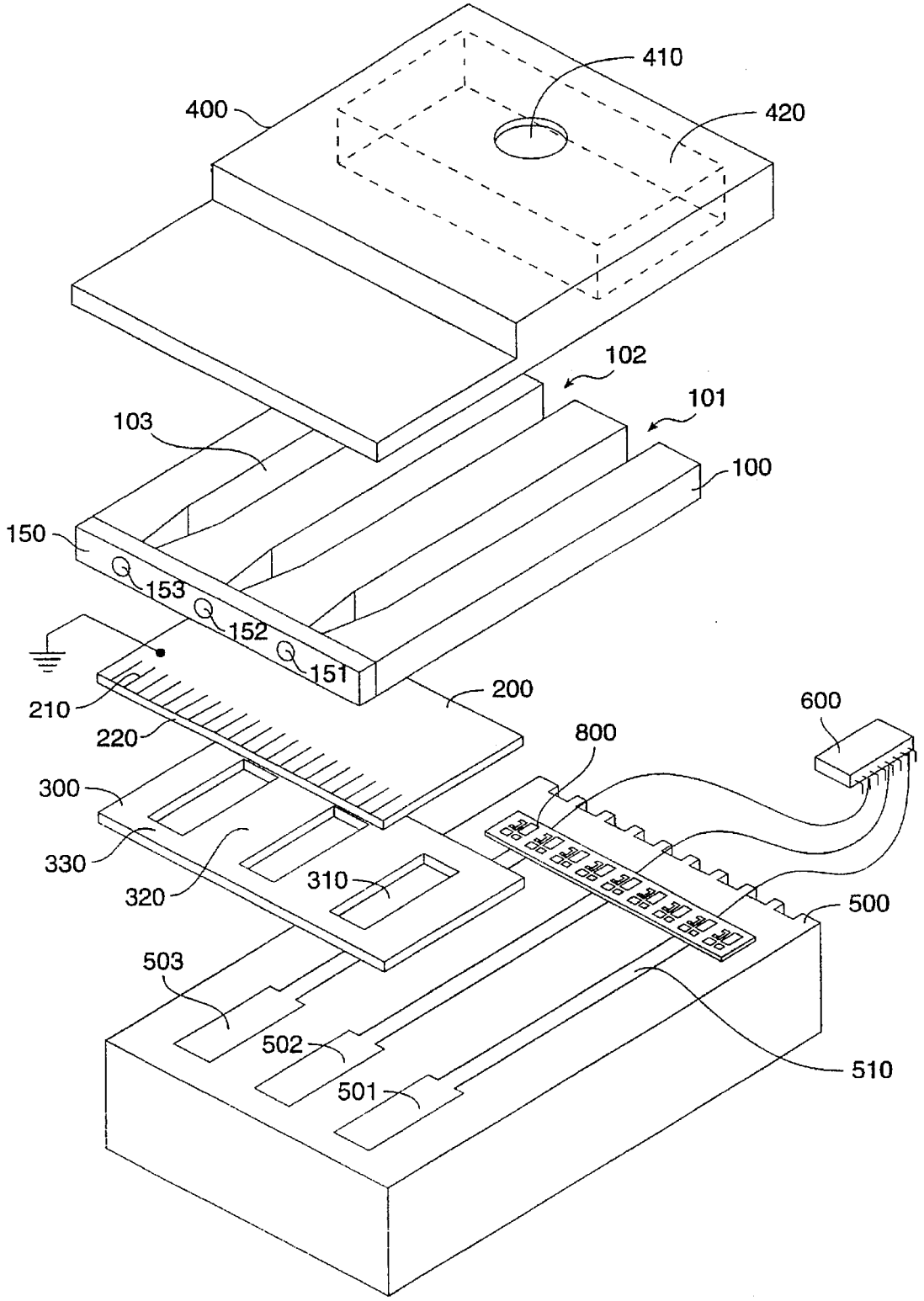
FIG. 1 is an expanded view of the side shooter embodiment of the invention.

Referring now to FIG. 1 the side-shooter embodiment of the present invention provides, in a preferred embodiment, a plurality of channels 101, 102, 103 are formed in a fluid impermeable substrate 100 by well-known photolithographic methods. Preferable substrate materials are photoimagable polyimide and Riston®. Other suitable materials such as silicon will be readily recognized by those skilled in the art. The channels are preferably terminated with a face plate 150, which comprises exit orifices 151, 152 and 153 respectively. The direction of the orifices are substantially perpendicular to the plane of the fluid impermeable substrate.

In this embodiment, a layer of electret 200 is positioned adjacent the substrate having channels defined therein and forms a portion of the confining structure of channels 101, 102, and 103. Electret 200 is a dielectric material, preferably a polar organic polymer possessing quasi or permanent charge in dipole storage capabilities. Typically, such polar organic polymers are crystalline or semi-crystalline in structure. We have found a fluoropolymer such as Teflon® FEP, Teflon® FTFE, or polyvinylidene fluoride to be preferable. Other suitable fluorocarbon polymers are Teflon® PFA, and PVF polyvinylfluoride. Fluorinated ethylene-propylene (FEP) copolymers are commercially available, for example, from DuPont under the trademarked name Teflon® FEP. PTFE is commercially available from DuPont under the trademarked name Teflon® PTFE Teflon® PFA, commercially available from DuPont under that trademarked name, is a polymer combining the carbon-flourine backbone of polytetrafluoroethylene resins with a perfluoroalkoxy side chain. A polar material PVCL F3 polyfluorotrifluoroethylene is also suitable in the device of our present invention, as is chlorinated polyethylene material. The electret 200 may be a copolymer of any of the above polymers, or a mixture thereof. Electret film may be cast from a single polymer or blend of two or more of the above polymers in a suitably compatible solvent, such as for example, cyclobenzene, or cyclohexanone. In another embodiment of our present invention, electret 200 may comprise two or more separate films attached to form a single "bielectret" electret layer. In another embodiment, dopants such as for example, titanium dioxide (TiO2), could be added to the electret to enhance charge storage and retention properties. Polymers and copolymers of acrylates such as PMMA (polymethylmethacrylate), styreneethyleneimids, polystyrene and polyimide also make suitable electret materials. Some of the above materials are sold commercially under the following names—Mylar® PETP sold by DuPont, Kapton® polyimide sold by DuPont, Perspex® polymethylmethacrylate sold by ICI, and polynite polystyrene film sold by Polychem.

The electret material utilized in the device and method of our present invention are not limited to those exemplary ones above. Electret materials that can be utilized are numerous and a more detailed review of such materials may be found in R. Gerhard-Multhaupt, *IEEE Transactions of Electric Insulators*, Vol. 22, pp. 53, 1987 under the title "Electrets," which is fully incorporated by reference herein.

Still with reference to FIG. 1, further provided in this embodiment is a dielectric capacitor spacing element 300 creating an air gap 310, photolithographically defined using a photoresist layer uni-formly spread and photoexposed on an A-Z photoresist substrate. Openings 310 create an air gap, preferably between about 1 and about 20 micrometers, more preferably between about 1 and about 10 micrometers, most preferably about 2 to about 3 micrometers in height. When photoresist is used, the photoresist layer is hardened in a well-known manner such as, for example, heat curing at 150° to provide stability. Any number of insulating layers such as silicon dioxide, silicon nitride, polyimide, aluminum oxide or the like may be used. The air gap capacitor spacing element 300 may be created by any number of well-known lithography and etching techniques. In this embodiment, shoulder areas 320 between the void spaces 310 and the planar edge areas 330 may be used as bonding surfaces to bond the capacitor spacing element to the electret surface.

Prior to attaching the electret 200 to the air gap capacitor spacing element 300, the polymer film should preferably be poled. The process of poling creates permanent or quasi-permanent positive and/or negative charged, oriented dipoles in the polymer film. To carry out one poling process, the polymer film is subjected to a high electric field while heating the material just below its softening point. To enhance the poling process, one or both sides of the film may be metallized to form an electrical contact surface. Subjecting the film to corona discharge, electron beam, ion beam, x-ray, neutral or active plasma, reactive plasma are other techniques by which the electret-material may be poled.

Alternatively, the polymer film may be poled after attachment to capacitor spacing element 300, in which case both surfaces of the polymer film are preferably metallized to make electrical contact.

In the device of our present invention, electret element 200 is securely attached to the channel element 100 on the top electret surface, and securely attached to the capacitor spacing element 300 on the bottom electret surface. Further elements of the device of this embodiment are described with reference to FIG. 1.

In a preferred embodiment, a reservoir 400 for containing and directing the flow of recording medium is molded in a fluid impermeable substrate. Preferable substrate materials are thermosetting plastics. However, the use of other materials is possible, and thus our invention is not limited to any particular substrate material. The recording medium may be, for example, aqueous or non-aqueous based ink. Reservoir and fluid supply element 400 may be either made separately from channel element 100, or integral therewith. The reservoir has fluid holding means 420 and an orifice 410, in this depiction positioned to be in fluid communication with the plurality of channels 101, 102, 103. In the preferred embodiment, a plurality of fluid supply orifices are provided, each such orifice being in fluid communication with one or more of the plurality of channels formed in substrate 100. Reservoir element 400 may be bonded to channel substrate 100 before, or after bonding of electret 200 to the opposite side of channel substrate 100, or simultaneous therewith. The reservoir is an intermediate reservoir in fluid communication with the chamber and with a supply reservoir.

The electret transducer device of the present invention further comprises a means to induce a voltage pulse to the electret in order to deform the electret and change the effective capacity of the recording medium containing chamber. In the preferred embodiment, electrodes are formed on an insulating substrate 500 such as for example, glass, alumina-type ceramic or polyimide-type printed wiring board. Other suitable substrates are-insulating films such as, for example, Kapton®, Lucite® or Teflon®. Substrate 500 could be integral with a silicon integrated circuit. Additional, suitable insulating substrates will be recognized by those skilled in the art.

A conductive layer is laid down, defined and etched photolithographically to result in bottom electrodes. In this representative embodiment electrodes 501, 502 and 503 are shown. Preferably, a portion of the electrodes, here for example 501, is dimensioned to match the dimensions of void space 310 in the air gap capacitor spacing element 300. Thus, when the air gap capacitor spacing element 300 is positioned adjacent insulator 500, the electrode portion so defined will match and form the base of the respective air gap capacitor. As may be further seen in FIG. 1, the defined electrode 501 preferably has a conductive extension 510 to which interconnective wiring may be contacted. In a preferred embodiment of the invention, substrate 500 is coupled to a silicon integrated circuit 800 which is extended to form the integrated recording device claimed herein. In such a device, for example, final driver transistors are electrically connected to electrode 501 through electrode extensions 510.

The device of the present invention further comprises a voltage pulse generation means 600, capable of selectively applying a voltage pulse which is typically between about 5 and about 35 volts, preferably about 25 volts and between about 5 microseconds and 15 microseconds in duration. When a voltage pulse is received by the electret in the region of a selected electrode, the electret itself deforms, or causes deformation of a flexible material having a metalized surface as described below with reference to the embodiment depicted by FIG. 7, thereby altering the volume and fluid containing capacity of the interior of the fluid containing chamber. Such volume alteration results in a drop of recording medium being ejected out of the orifice or exit nozzle at a velocity of between about 3 and about 8 meters per second, preferably about 5 meters per second.

As one example, for the print head embodiment comprising channels at a density resulting in a 300 dot per inch configuration, a deformation of about 15 micrometers will achieve good results in the displacement of fluid from the fluid containing chamber. Further, in the preferred embodiment when the voltage pulse selectively applied to the conductive extension 510. The electret causing ejection of recording medium through for example orifice 151, falls again to zero voltage, the deformable electret returns to the electret normal and original position, causing ink from reservoir 400 to flow through orifice 410 into channel 102. In the exemplary embodiment represented in FIG. 1, recording medium is ejected through nozzle 151 in a perpendicular direction relative to the axis of the deformable membrane electret 200. Such an arrangement is generally referred to as a "side shooter."

In one embodiment, the electret element 200 is provided with a metallized surface 210 being externally connected to the electrical ground. Alternatively, grounding may be accomplished by making the recording medium conductive and using the recording medium as the electrical return path to the ground.

In a preferred embodiment of the invention, a single electret transducer film 200 is utilized in the assembly of an array of drop-on-demand ink jet ejectors. A plurality of electrodes 501, 502, 503, etc. divide the deformable electret transducer into discrete sections which correspond to individual respective channels and ejecting nozzles 151, 152, 153, etc. Ejecting nozzles are spaced on centers of a distance, such as about 43 micrometers, about 63 micrometers, or about 84 micrometers, from the closest of other of the ejecting nozzles.

Figure 2:
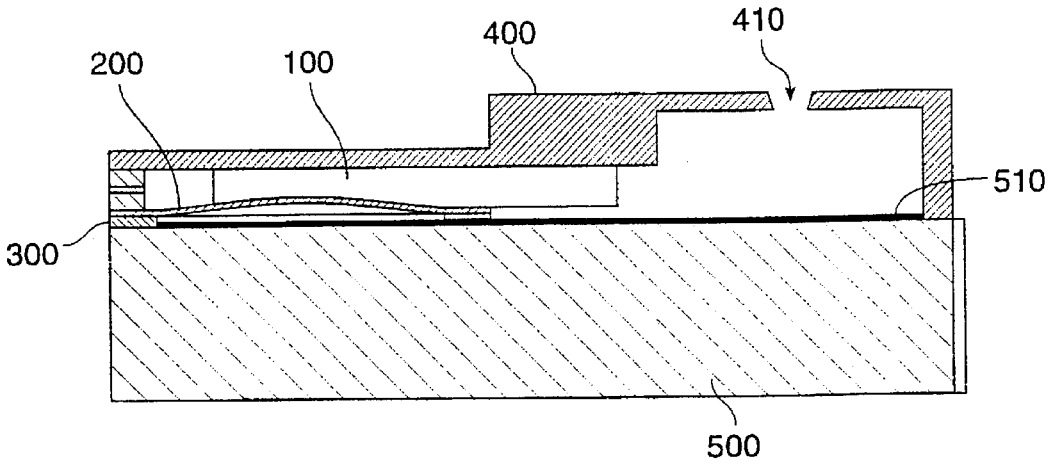
FIG. 2 is a cross-section view of an assembled side shooter embodiment.

A cross-section view of one embodiment of the recording device of the present invention is depicted in FIG. 2. Electret membrane element 200, shown here in the deformed state, is preferably between about 2 and about 25 micrometers thick, preferably between about 10 and about 15 micrometers. The electret film comprises one or more of the polymers having specific properties described above.

Figure 3:
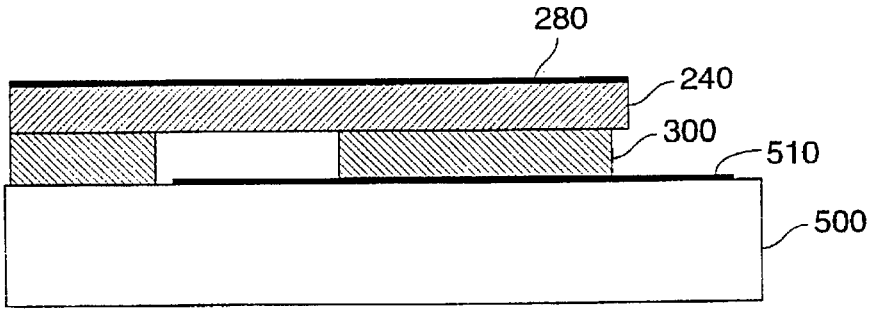
FIGS. 3–6 are cross-section views representing various embodiments of the printhead device comprising electret transducer.
Figure 4:
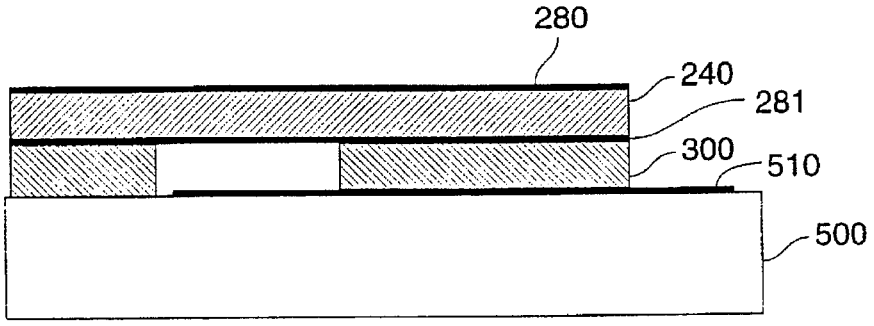

In an alternative embodiment depicted by FIG. 3, the electret element 240 is provided with one surface having been metallized with metal coating 280 and bonded to the air gap capacitor spacing element 300. Alternatively, the embodiment depicted in FIG. 4 comprises both surfaces 280 and 281 of the electret element 240 having been metallized. The device depicted in FIG. 4 performs as two capacitors in series; the air gap and the metallized electret. The advantage of this embodiment is that the polymer electret need not be polarized prior to bonding and assembly. In situ poling may be accomplished by applying a electric field of the order of about 20 kV per mm between metallized surfaces 280 and 281.

Figure 5:
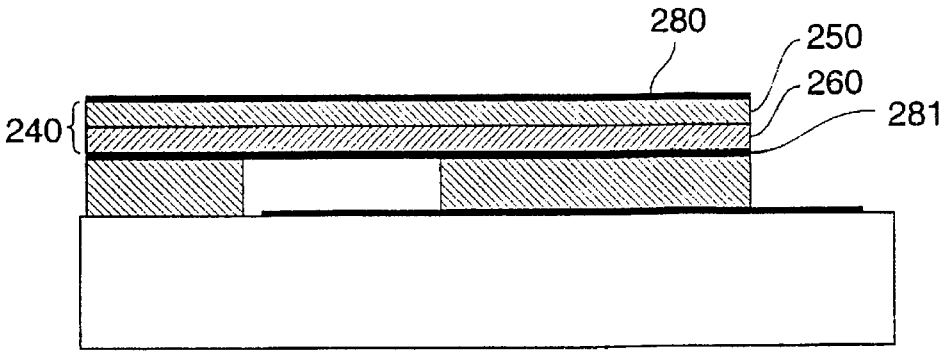

In a further embodiment depicted in FIG. 5, the electret film element 240 comprises two separate polymer layers 250 and 260 bonded together, which we will refer to as bipolymeric electret, or simply "bi-electrets" or "multi-electrets." Such a combination of two or more electret films, forming a single capacitor, are alternatively useful in obtaining a desired deformation characteristics of the electret element in displacing recording medium from fluid containing chambers in the process and devices of our present invention. As an example, and not to limit our invention in any way, one electret film may be a 10 micron PMMA film and a second electret film may be 10 micron polyvinyladine fluoride film. In such a chosen combination, the PMMA film has a net positively stored charge, and the polyvinyladine fluoride film is chosen to have a net negative charge. Such a combination enhances the deformation characteristics of the electret transducer and improves the deformation characteristics and improves the efficiency of the resulting device.

Figure 6:
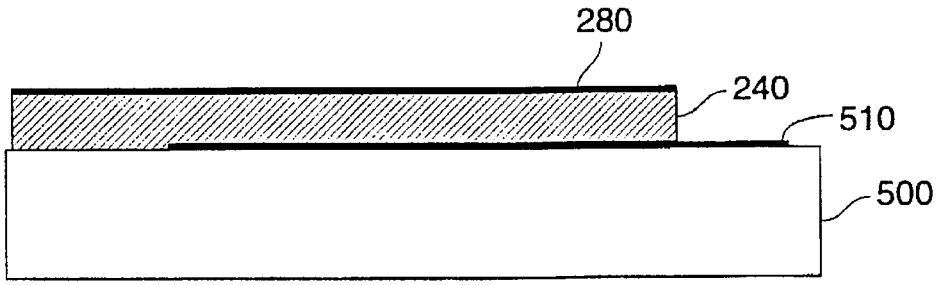

In yet another embodiment depicted in FIG. 6, the electret may be formed directly on the substrate 500 over the electrode 510. This eliminates the air gap. This will have advantages of allowing manufacturing of thinner films and eliminate handling. The electret should preferably be poled in situ in this case.

Figure 7:
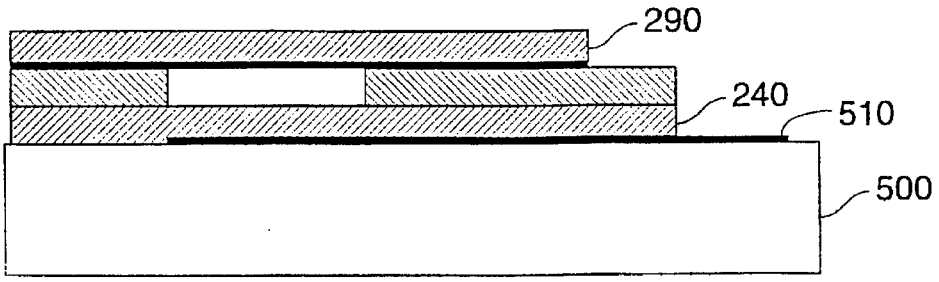
FIG. 7 depicts an additional embodiment of the electret transducer.

In another embodiment depicted in FIG. 7, the electret is in contact and is fixed to a first electrode 510. The second electrode 290 is deformable and has a metalized surface, preferably the surface facing the air gap. The deforming forces in response to an external applied voltage and as described in the previous embodiments. However, the embodiment depicted in FIG. 7 allows the use of various membranes as the deformable body and allows a larger variety of materials for the electrode. In this embodiment the electret is fixed and allows use of inorganic electret, such as for example silicon dioxide which are more compatible with semiconductor processing technologies. In this embodiment the electret does not directly contact recording medium in the fluid chamber. Instead, an inert flexible electrode forms a portion of the fluid chamber, and contacts the fluid.

An alternative method of manufacturing the blended electret described is also provided. The process comprises dissolving suitable electret polymers in a mutually compatible solvent, thereafter casting the film and poling the resulting material. As an example, and not to limit our invention in any way, a solution containing 5 volume percent PMMA and 5 volume percent of polyvinyladine fluoride in cyclobenzene is thoroughly mixed in an ultrasonic bath and thereafter filtered. The resulting somewhat viscous solution is utilized in the casting of a electret film of approximately 15 micrometer thickness. This resulting film is dried, metallized and poled to finish the blended electret component.

For convenience and to enable a better understanding of the embodiments of our present invention, the figures depict only three corresponding electrodes, ink supplied chambers and orifices. However, the embodiments and devices of our present invention may comprise any number of such combinations in a high density linear array printhead. In a typical shuttle type moving printhead the number of such combinations are between about 48 to 384, while a non-moving page wide printer may have 2400 to 4800 combinations of electrodes and corresponding ink supplied channels.

Figure 8:
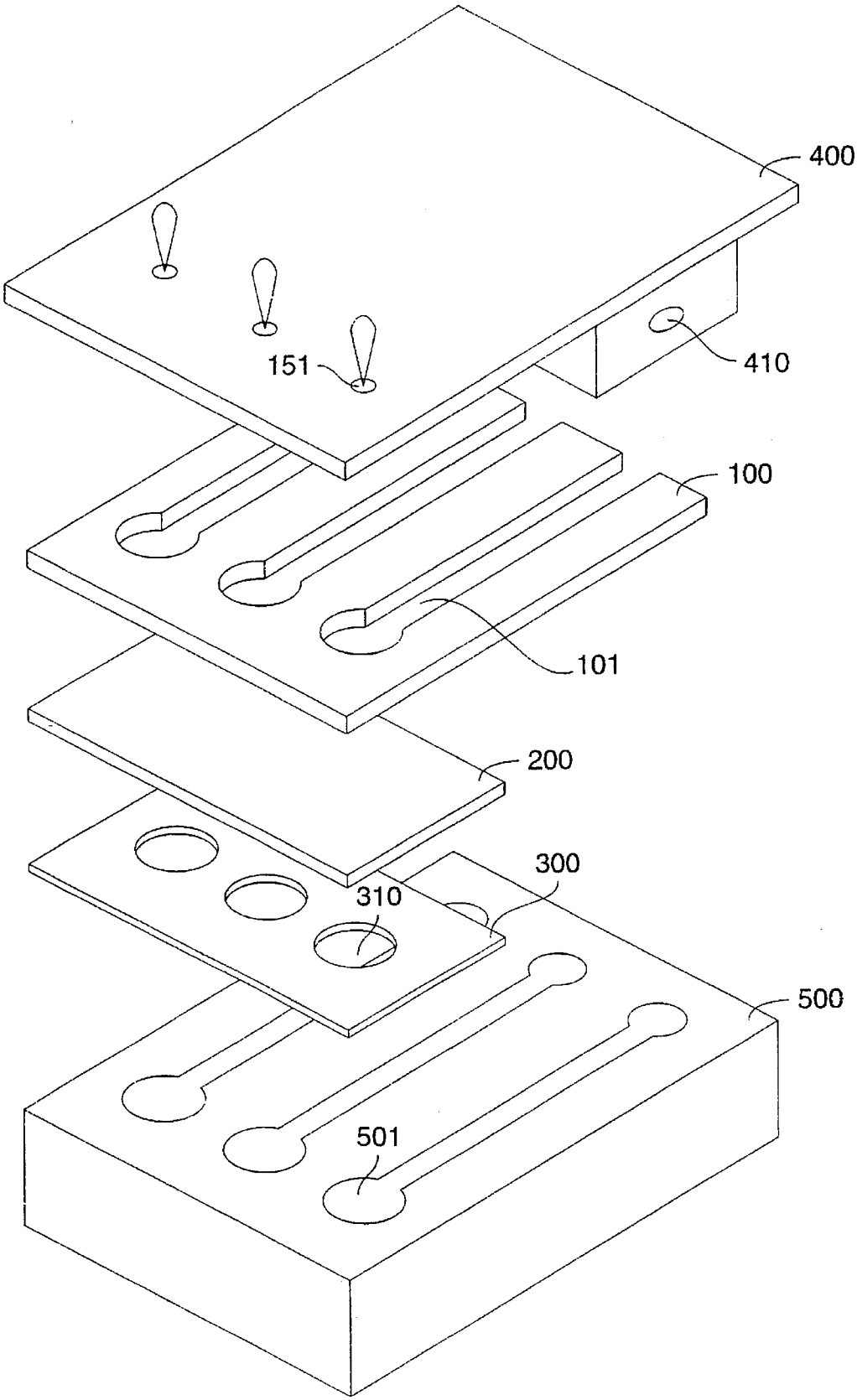
FIG. 8 is an expanded view of the roof shooter embodiment of the present invention.

In yet another embodiment of our present invention, a roof shooter type recording device is depicted in FIG. 8. In the roof shooter embodiment of our invention, the elements and methods of manufacture and assembly are essentially the same as for the side shooter embodiment, with the exception being a substitution of orifices in a roof element bonded to the top of channel substrate 100 and the channels 101, 102, 103 being formed in substrate 100 without themselves having an exit orifice.

Figure 9:
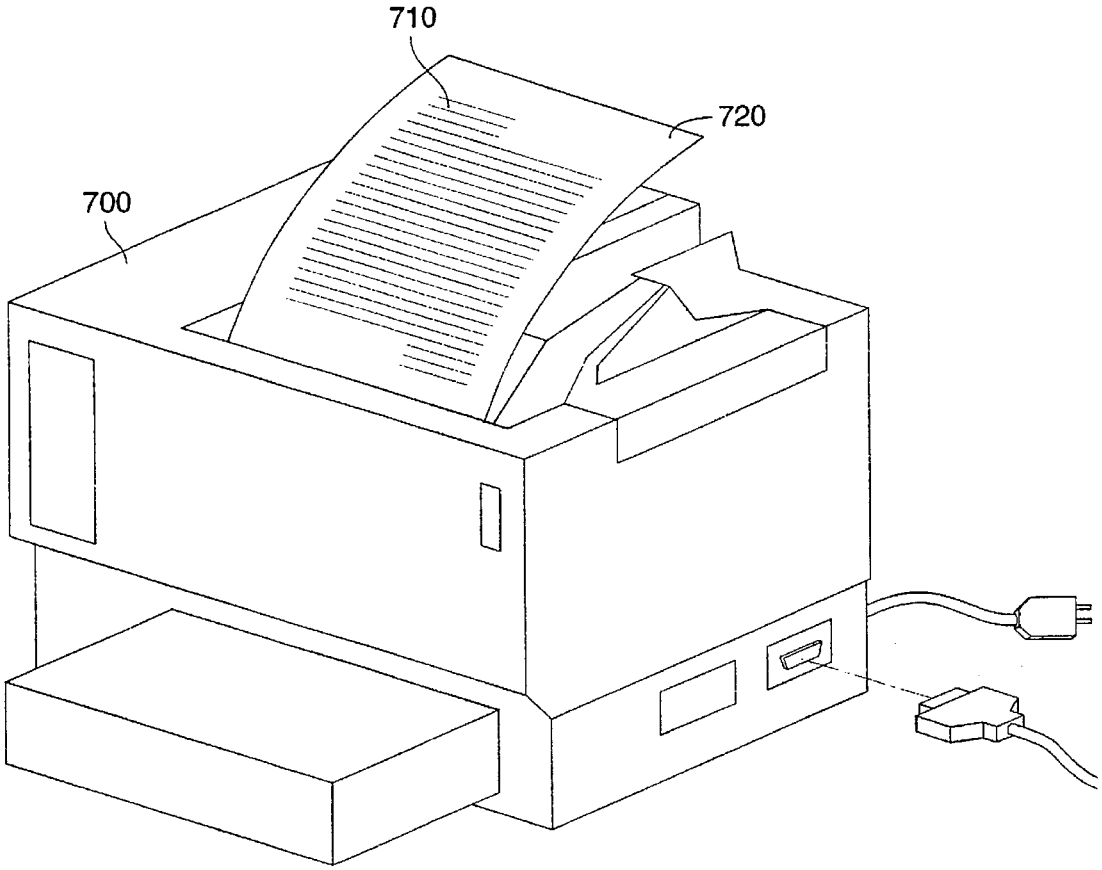
FIG. 9 is a depiction of the printer embodiment of the invention.

Referring to FIG. 9, a printer 700 is provided with a printhead in accordance with the present invention. Recording surface 720 is placed by well known recording surface handling means in close proximity to the exit orifices of the printhead. In accordance with the present invention, recording medium is selectively ejected through printhead exit orifices onto the recording medium to result in recordings 710. Following such operation, the recording medium may be removed from the printer.

The invention having now been described with reference to specific embodiments, other embodiments will be apparent to those of ordinary skill in the art. For example, the shape of the electrodes, air gap capacitors and fluid containing channels may vary. Alternatively, the order in which the elements are individually defined and the device assembled is a matter of preference. It is therefore not intended that this invention be limited, except as indicated in the appended claims, along with the full scope of equivalents to which the claims are entitled.

Although the foregoing invention has been described in some detail by way of illustration and example for purposes of clarity of understanding, it will be obvious that certain changes and modifications may be made and practiced by those skilled in the art while being within the scope of the appended claims.

What is claimed is:

1. A recording device comprising:

a recording head comprising a chamber, the chamber formed in a substrate, the chamber including a top surface and a bottom surface, a capacitive electret transducer including an electret and a first electrode, the first electrode formed on an insulating substrate that is substantially flat, wherein the first electrode is electrostatically coupled to at least a portion of the electret to form the capacitive electret transducer, and wherein the capacitive electret transducer defines the bottom surface of the chamber;

a recording medium source forming the top surface of the chamber, said recording medium source supplying recording medium from a reservoir to the chamber; and a voltage pulse source coupled to the first electrode, said voltage pulse source selectively causing deformation of at least a portion of the electret and ejection of a quantity of recording medium from the chamber.

2. The recording device as recited in claim 1 wherein the chamber is formed by photolithography on the substrate which comprises silicon.

3. The recording device as recited in claim 1 wherein the reservoir is molded using thermosetting plastics.

4. The recording device as recited in claim 1 further comprising an orifice in fluid communication with the chamber, said orifice ejecting recording medium from the chamber.

5. The recording device as recited in claim 4 wherein the substrate defines a plane, and wherein said orifice is defined in the substrate in a direction perpendicular to a plane of the substrate.

6. The recording device as recited in claim 4 wherein orifice is defined in a roof member coupled to the substrate and in fluid communication with the chamber, said roof member comprising fluid impermeable material.

7. The recording device as cited in claim 4 wherein the orifice is positioned substantially perpendicular to a line in a plane of the electret.

8. The recording device as recited in claim 1 wherein the electret is of a material selected from the group consisting of: PMMA, FEP, PTFE, polyvinylidene fluoride PFA, PFV polyvinylfluoride, PVCL F3 polyfluorotrifluoro-ethylene, chlorinated polyethylene, and polyamide.

9. The recording device as recited in claim 8 further comprising a plurality of first electrodes, wherein said plurality of first electrodes includes said first electrode, and wherein said plurality of first electrodes is electrostatically coupled to the electret to form a plurality of capacitive electret transducers; and wherein said voltage pulse source comprises logic means for electrically contacting said plurality of first electrodes, and a voltage pulse generation means for generating a voltage pulse to at least one of said plurality of first electrodes, and wherein said logic means and said voltage pulse generation means cooperate to selectively produce the voltage pulse to cause deformation of the electret.

10. The recording device as recited in claim 9 wherein said logic means comprises an intergrated logic circuit.

11. The recording device as recited in claim 1 further comprising a second electrode in fluid contact with the chamber, wherein said second electrode comprises a flexible film having at least one metallized surface; and wherein the capacitive electret transducer defines the bottom surface of the chamber through said second electrode, and the capacitive electret transducer is not in fluid contact with the chamber.

12. The recording device as recited in claim 1 wherein said first electrode is photolithographically defined and etched on the insulating substrate.

13. The recording device as recited in claim 12 further comprising an air gap capacitor comprising an A-Z photoresist having at least one area thereof photolithographically removed in a defined spaced apart manner to align with said first electrode when said air gap capacitor is positioned adjacent to the insulating substrate, and wherein the electret is coupled to said first electrode through said air gap capacitor.

14. The recording device as recited in claim 1 wherein the recording medium is a non-aqueous based ink.

15. The recording device as recited in claim 1 wherein the reservoir is an intermediate reservoir in fluid communication with the chamber and with a supply reservoir.

16. The recording device as recited in claim 1 further comprising:

an insulation layer including an opening therein, wherein said insulation layer between the electret and the first electrode, and wherein said opening forms an air gap between the electret and the first electrode.

17. The recording device as recited in claim 1, wherein the electret comprises at least two separate films.

18. The recording device as recited in claim 17 wherein said electret has at least one metallized surface.

19. The recording device as recited in claim 1 wherein said electret has at least one metallized surface.

20. A drop-on demand recording print head comprising:

a plurality of chambers, each of the chambers having a top surface, a bottom surface, an ejecting nozzle and a supply orifice, said plurality of chambers formed in a substrate;

recording medium supply means for supplying recording medium to said plurality of chambers, said recording medium supply means forming the top surface of the plurality of chambers and in fluid communication with each supply orifice;

a plurality of capacitive transducers, said plurality of capacitive transducers defining the bottom surface of the plurality of chambers, said plurality of capacitive transducers including an electret and a plurality of first electrodes electrostatically coupled to the electret, the plurality of first electrodes formed on an insulating layer that is substantially flat; and means for selectively supplying a voltage pulse to each of the plurality of capacitive transducers, wherein said means for selectively supplying a voltage pulse is coupled to said plurality of first electrodes.

21. The drop-on-demand recording print head as recited in claim 20, wherein the plurality of first electrodes are spaced apart and photolithographically defined and etched in the insulating substrate.

22. The drop-on-demand recording print head as recited in claim 21 further comprising a composite capacitor defined in an insulator having a top insulating side and a bottom insulating side, said composite capacitor comprising spaced apart removed portions, the top insulating side positioned adjacent the electret opposite the substrate to align the plurality of removed portions with said electret; and wherein the plurality of first electrodes is coupled to said electret through said composite capacitor; and wherein the insulating substrate is positioned adjacent the bottom insulating side of said composite capacitor.

23. The drop-on-demand recording print head as recited in claim 21 or 22, wherein said means for selectively supplying a voltage pulse comprises an integrated logic circuit defined on the insulating substrate and in electrical connection with the plurality of first electrodes, and a voltage generation means for selectively controlling the input of the voltage pulse to each of the plurality of first electrodes.

24. The drop-on-demand recording print head as recited in claim 20 wherein said plurality of chambers and a plurality of the ejecting nozzles are linearly positioned to form an integral high density linear array.

25. The drop-on-demand recording print head as recited in claim 20 wherein the ejecting nozzles are spaced on centers of about 84 micrometers from the closest of other of the ejecting nozzles.

26. The drop-on-demand recording print head as recited in claim 20 wherein the ejecting nozzles are spaced on centers of about 63 micrometers from the closest of other of the ejecting nozzles.

27. The drop-on-demand recording print head as recited in claim 20 wherein the ejecting nozzles are spaced on centers of about 43 micrometers from the closest of other of the ejecting nozzles.

28. The drop-on-demand recording print head as recited in claim 20, wherein said recording medium supply means comprises a reservoir.

29. A recording head in an array ink jet assembly comprising:

a plurality of chambers, each of the chambers in fluid communication with a respective one of a plurality of droplet exit orifices and a respective one of a plurality of reservoir inlet orifices, the chambers having a top chamber wall and a bottom chamber wall, wherein the bottom chamber wall is defined by a capacitive electret transducer, the capacitive electret transducer comprising a first electrode and at least one deformable polymer film electret that is electrostatically coupled to the first electrode, wherein the first electrode receives an electrical pulse to cause said at least one deformable polymer film electret to deform.

30. A method of printing recording medium to a recording surface, comprising the steps of:

positioning a recording surface in close proximity to a printhead, said printhead comprising a chamber including a top surface and a bottom surface, wherein the bottom surface is defined by a capacitive electret transducer, the capacitive electret transducer comprising a first electrode and an electret that is electrostatically coupled to the first electrode, the first electrode formed on a substantially flat insulating substrate, a recording medium source forming the top surface of the chamber and supplying recording medium from a reservoir to the chamber, and a voltage pulse source coupled to the first electrode to selectively deform the electret; and ejecting a quantity of recording medium from the chamber onto the recording surface.

31. A recording device comprising:

a recording head comprising a chamber, at least a portion of the chamber comprising a capacitive electret transducer, said capacitive electret transducer comprising a first electrode on an insulating substrate and an electret, wherein the electret is not in fluid contact with the chamber and the electret is electrostatically coupled to the first electrode;

a recording medium source for supplying recording medium from a reservoir to the chamber; and a voltage pulse source coupled to the first electrode, said voltage pulse source selectively causing deformation of the capacitive electret transducer and ejection of a quantity of recording medium from the chamber; and a second electrode in fluid contact with the chamber, the second electrode comprising a flexible film having at least one metallized surface, the second electrode coupled to the electret; and an air gap capacitor comprising an A-Z photoresist having at least one area thereof photolithographically removed in a defined spaced apart manner to align with at least the first electrode when the air gap capacitor is positioned adjacent to the insulating substrate.

32. A recording device comprising:

a recording head comprising a chamber formed in a substrate, at least a portion of the chamber comprising an electret transducer, the electret transducer comprising an electrode and an electret selected from the group consisting of: PMMA, FEP, PTFE, polyvinylidene fluoride, PFA, PVF polyvinylfluoride, PVCL F3 polyfluorotrifluoro-ethylene, chlorinated polyethylene, and polyimide;

a recording medium source for supplying recording medium from a reservoir to the chamber;

a voltage pulse source coupled to the electrode selectively causing deformation of the electret transducer and ejection of a quantity of recording medium from the chamber, wherein said voltage pulse source comprises an integrated logic circuit, and a voltage supply means for supplying a voltage pulse, the integrated logic circuit and the voltage supply means cooperating to selectively produce a voltage pulse to the electrode to cause deformation of the electret and ejection of the quantity of recording medium; and a composite capacitor defined in an insulator having a top insulating side and a bottom insulating side, the composite capacitor comprising spaced apart removed portions, the top insulating side positioned adjacent the electret opposite the substrate to align the plurality of removed portions with the electret.

* * * * *